United States Patent [19]

Keyes, IV et al.

[11] Patent Number: 4,549,503

[45] Date of Patent: Oct. 29, 1985

[54] MAXIMUM EFFICIENCY STEAM TEMPERATURE CONTROL SYSTEM

[75] Inventors: Marion A. Keyes, IV, Chagrin Falls; Michael P. Lukas, Eastlake; William H. Moss, Concord Township, Lake County, all of Ohio

[73] Assignee: The Babcock & Wilcox Company, New Orleans, La.

[21] Appl. No.: 609,624

[22] Filed: May 14, 1984

[51] Int. Cl.[4] ..... F22G 5/00

[52] U.S. Cl. ..... 122/479 R; 122/460; 122/479 S; 60/667

[58] Field of Search ..... 122/479 R, 479 S, 460, 122/504; 60/329, 667

[56] References Cited

U.S. PATENT DOCUMENTS

| | | | |
|---|---|---|---|
| 3,172,462 | 3/1965 | Bruhner | 122/479 S X |
| 3,183,897 | 5/1965 | De Livois | 122/479 R |
| 3,640,250 | 2/1972 | Costello et al. | 122/479 S |
| 4,144,846 | 3/1979 | Miszak | 122/479 R |
| 4,241,701 | 12/1980 | Morse | 122/479 R X |
| 4,296,730 | 10/1981 | Zadiraka | 122/479 R X |

FOREIGN PATENT DOCUMENTS

| | | | |
|---|---|---|---|
| 3121442 | 1/1983 | Fed. Rep. of Germany | 122/479 R |

*Primary Examiner*—Edward G. Favors

*Attorney, Agent, or Firm*—Vytas R. Matas; Robert J. Edwards

[57] ABSTRACT

A system is disclosed for increasing the main steam temperature in a boiler/turbine installation to the maximum level consistent with safe operation of the installation. The difference between the main steam temperature and a system parameter is determined and used as an index to adjust the main steam temperature set point upward or downward. The system parameter selected for comparison with the main steam temperature may be the allowable variance between the main steam temperature and the main steam temperature set point or may be a "safety margin" temperature selected so as to be below the maximum allowable temperature for the installation.

5 Claims, 5 Drawing Figures

MAXIMUM EFFICIENCY STEAM TEMPERATURE CONTROL SYSTEM

TECHNICAL FIELD

This invention generally relates to a system for controlling the main steam temperature in a power generation boiler/turbine installation and more particularly to a control system which permits increasing the main steam temperature to the maximum level consistent with safe operation of the installation.

BACKGROUND ART

The typical approach to steam temperature control in a boiler/turbine installation is to operate at the maximum possible main steam temperature, so as to maximize system efficiency, while not exceeding the maximum metal temperatures allowed in the boiler and/or turbine or the maximum allowed rate of change of these temperatures. Such temperature control is generally accomplished through a combination of feedforward and feedback controls that utilize a combination of pressure, temperature, steam flow, and heat flow measurements to adjust the final superheat temperature, i.e., the main steam temperature. This adjustment usually involves varying the water flows through an attemperating spray valve into the secondary superheater section of the system or by varying the flue gas recirculation rate through the boiler. In any event, the system requires the establishment of a main steam temperature set point. Inasmuch as there is a wide variation in possible operating conditions for the boiler and since these control systems do not provide for the automatic reduction of this set point if the main steam temperature approaches the danger level, the main steam temperature set point is selected in a conservative manner so that the main steam temperature safety limit is not exceeded over the full range of boiler operating conditions and possible disturbances. The end result of having to utilize a conservative value for the main steam temperature is that the boiler/turbine installation does not operate at maximum efficiency.

Because of the foregoing, it has become desirable to develop a control system for a boiler/turbine installation which would permit the installation to operate at maximum efficiency over the full range of boiler operating conditions.

SUMMARY OF THE INVENTION

The present invention solves the aforementioned problems associated with the prior art as well as other problems by providing a mechanism for adjusting the main steam temperature set point to the maximum level possible consistent with safe system operation, thus maximizing the efficiency of the boiler/turbine installation with respect to the steam temperature variable. The foregoing is accomplished by measuring the difference between the main steam temperature and another system parameter, and then using this difference as an index to ramp the set point upward or downward. In one embodiment of the invention, the index used is the measured variance of the main steam temperature about the set point. In this case, the measured variance is compared to an allowable variance, and the set point is ramped upward or downward as a result of this comparison. In another embodiment of the invention, the index used is the difference between the main steam temperature and a "safety margin" temperature parameter. In this latter case, the set point is ramped upward or downward depending upon whether the main steam temperature is less than or greater than the "safety margin" temperature parameter.

DESCRIPTION OF THE PREFERRED EMBODIMENT

Figure 1:
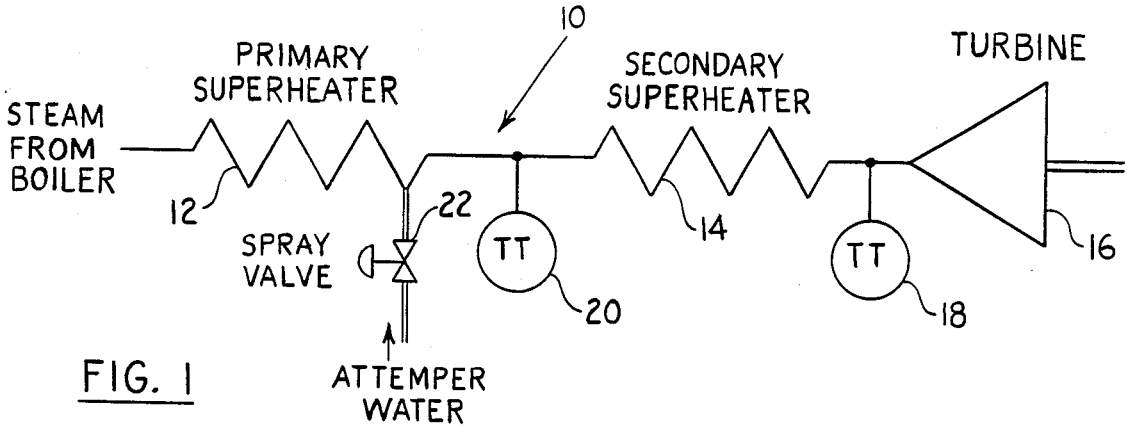
FIG. 1 is a schematic diagram of a typical system used for regulating the steam temperature in a boiler/-turbine installation.

Referring now to the drawings where the illustrations are for the purpose of describing the preferred embodiment of the present invention and are not intended to limit the invention hereto, FIG. 1 is a schematic diagram of a mechanism 10 generally used to regulate the steam temperature in a boiler/turbine installation. This mechanism 10 includes a primary superheater 12 connected to the output of the steam boiler, a secondary superheater 14 connected to the output of the primary superheater 12, and an attemperating water supply connected to the input to the secondary superheater 14 via a spray valve 22. A temperature transmitter 18 is located between the output of the secondary superheater 14 and the input to the turbine 16 so as to measure the main steam temperature. Similarly, a temperature transmitter 20 is located between the output of the primary superheater 12 and the input to the secondary superheater 14 so as to measure the inlet temperature of the steam to the superheater 14. In this mechanism, the temperature measurements produced by the temperature transmitters 18 and 20 are used to adjust the flow of the attemperating water, via the spray valve 22, into the secondary superheater 14. In this manner, the temperature of the steam within the system is kept at a high level in order to maintain a high level of system efficiency.

Figure 2:
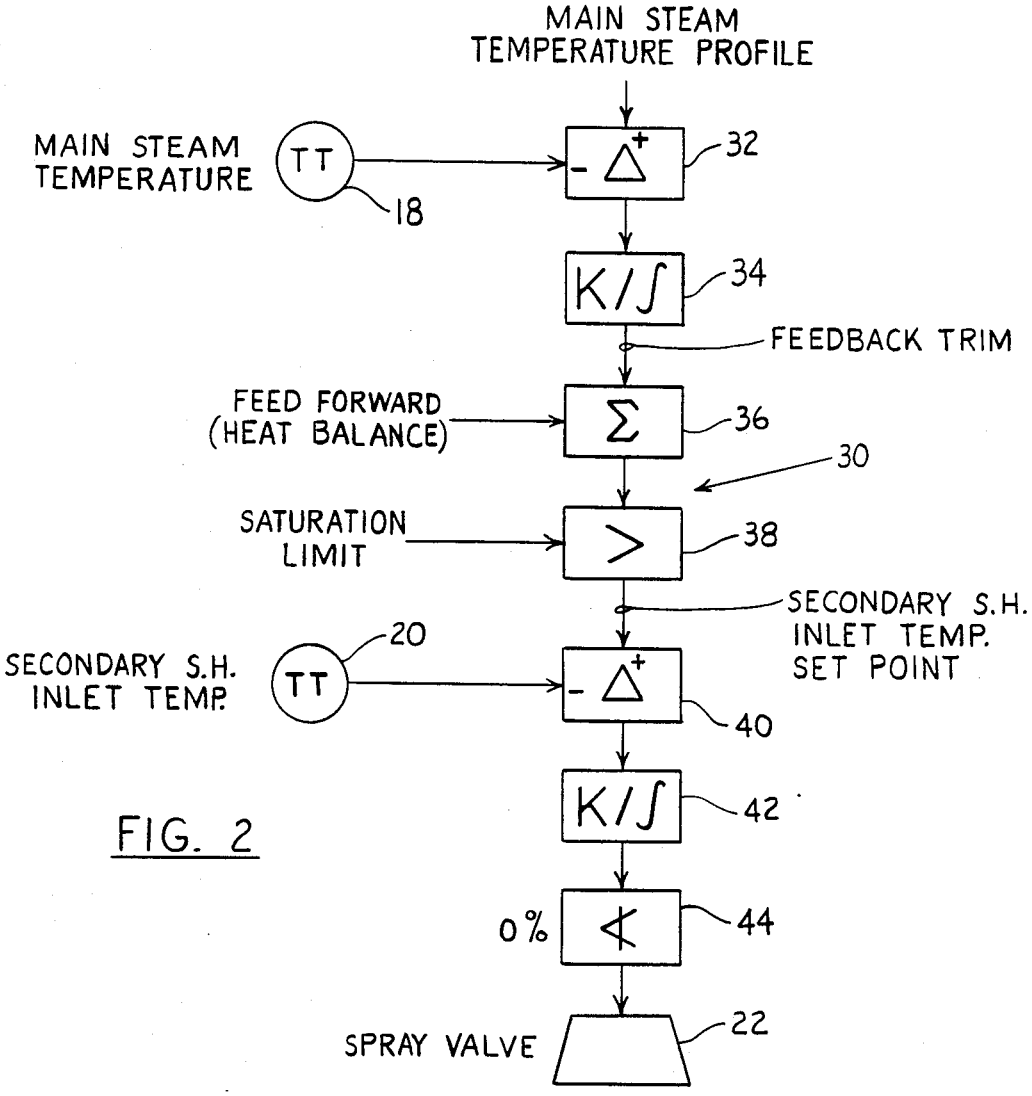
FIG. 2 is a schematic diagram of the control logic, and the function blocks comprising same, used to regulate the operation of the spray valve of FIG. 1.

A typical method of controlling this spray valve 22 is accomplished by control logic 30 shown schematically in FIG. 2. In this Figure, the temperature measurement produced by the temperature transmitter 18, which represents the main steam temperature, is applied to the negative input to a difference function block 32, and the "main steam temperature profile" is applied to the positive input to this function block 32. It should be noted that the "main steam temperature profile" is a control set point which is adjusted during "start-up" conditions and rapid load changes and varies significantly during these periods to minimize thermal stresses within the system. However, during steady-state operation of the system, the "main steam temperature profile" is fixed at a constant level, and this level is typically selected in a very conservative manner so that the steam temperature safety limit is never exceeded over the complete range of boiler operating conditions and expected disturbances.

The output of the difference function block 32, which represents the difference between the "main steam temperature profile" and the main steam temperature, is applied to the input to a proportional and integral controller function block 34 which produces an output signal representative of the feedback trim that is required in the system. This feedback trim signal and a feedforward signal, generated from heat balance equations, are applied as inputs to a summation function block 36. It should be noted that the feedforward signal is the primary dynamic component of the set point for the inlet temperature of the steam to the secondary superheater 14, and the feedback trim signal adjusts for errors in the heat balance equations and associated measurements. The output of the summation function block 36, which represents the desired secondary superheater inlet temperature set point, and a steam saturation temperature limit are applied as inputs to a high selecting function block 38. If the desired secondary superheater inlet temperature is less than the steam saturation temperature limit, the function block 38 produces an output signal representative of the steam saturation temperature limit which is applied to the positive input to a difference function block 40. The temperature measured by the temperature transmitter 20, which represents the actual secondary superheater steam inlet temperature, is applied to the negative input to this function block 40. The output of the function block 40, which represents the difference between the steam saturation temperature limit and the actual secondary superheater steam inlet temperature, is applied as the input to a proportional and integral controller function block 42 which produces an output signal representative of the difference therebetween, i.e., the correction required in the attemperating water flow. The output of the function block 42 is applied as the input to a low limiting function block 44, having a low limit of zero, to produce an output signal representative of the correction required in the attemperating water flow. The output signal produced by the function block 44 is applied as an input to the spray valve 22 to regulate the flow of attemperating water therethrough to the secondary superheater 14.

The foregoing system has some inherent disadvantages as a result of the wide variation in possible operating conditions of the boiler. Because of these wide variations, the steady-state level of the "main steam temperature profile" must be set at a conservative level much below the safety point. This leads to a reduction in main steam temperature which, in turn, results in a reduction in overall boiler/turbine efficiency. Alternatively, if this steady-state level is set too high for the boiler involved, there is no provision in the control system to automatically reduce this set point if the steam temperature approaches the danger level.

The present invention overcomes the foregoing disadvantages in that it provides a mechanism for increasing the steady-state level of the main steam temperature set point to the maximum level possible consistent with safe system operation. In this manner, the invention maximizes the efficiency of the boiler/turbine installation with respect to the steam temperature variable. In addition, the invention provides a mechanism for backing off from this set point if fluctuations in the main steam temperature begin to approach the danger level.

Figure 3:
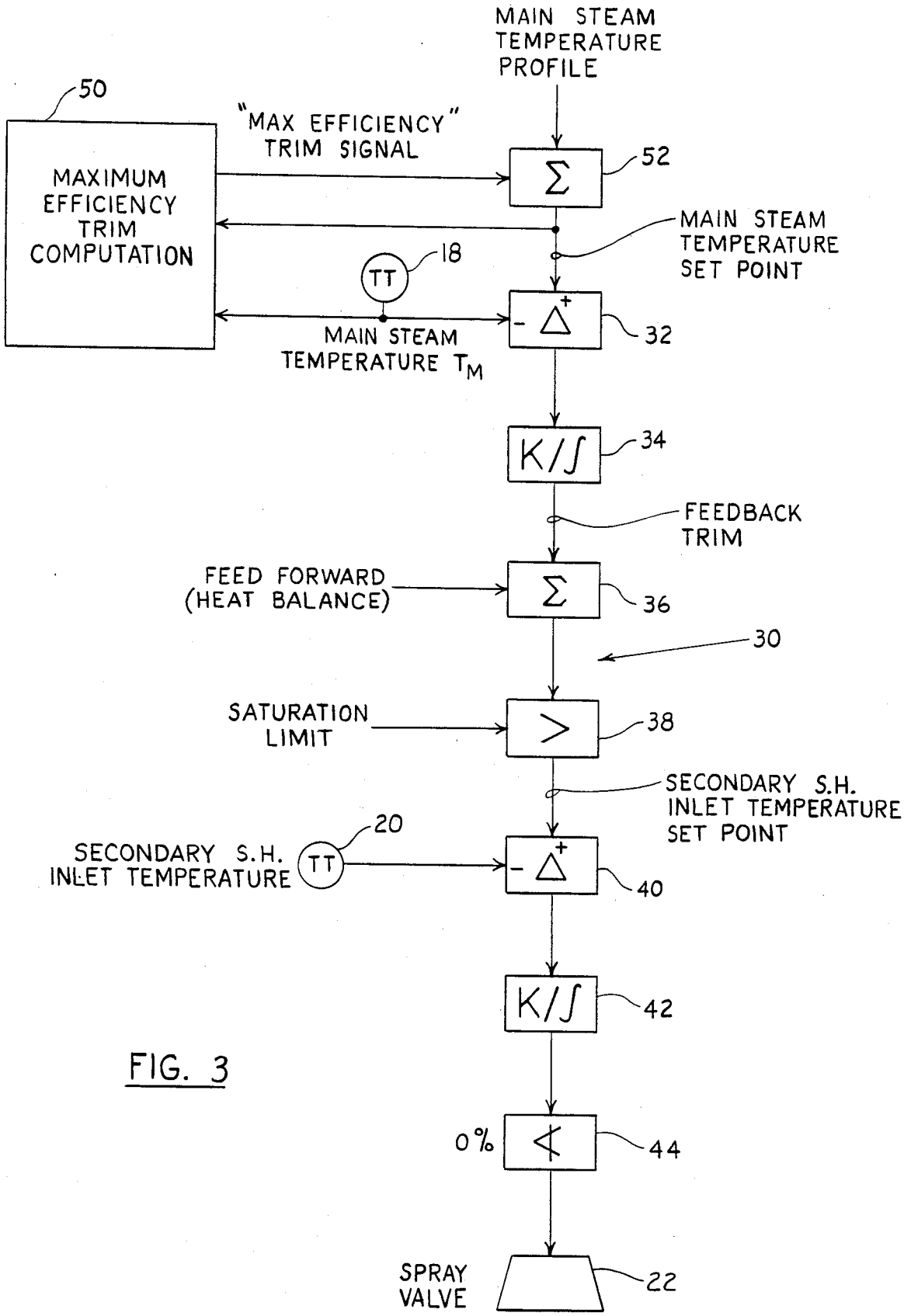
FIG. 3 is a schematic diagram of the invention of this disclosure as incorporated in the control logic of FIG. 2.

The present invention involves a maximum efficiency trim computation apparatus 50 which is interconnected to the control logic 30, as shown schematically in FIG. 3. In this schematic arrangement, the "main steam temperature profile" and the output of the maximum efficiency trim computation apparatus 50 are inputs to a summation function block 52. The output of this function block 52 is representative of the main steam temperature set point and is an input to the maximum efficiency trim computation apparatus 50 and is applied to the positive input to the difference function block 32. In addition, the measurement of the main steam temperature by the temperature transmitter 18 is applied to an input to the maximum efficiency trim computation apparatus 50 and to the negative input to the difference function block 32. In this manner, the "main steam temperature profile" is replaced by a readily variable main steam temperature set point as the signal that is applied to the positive input to the difference function block 32.

Figure 4:
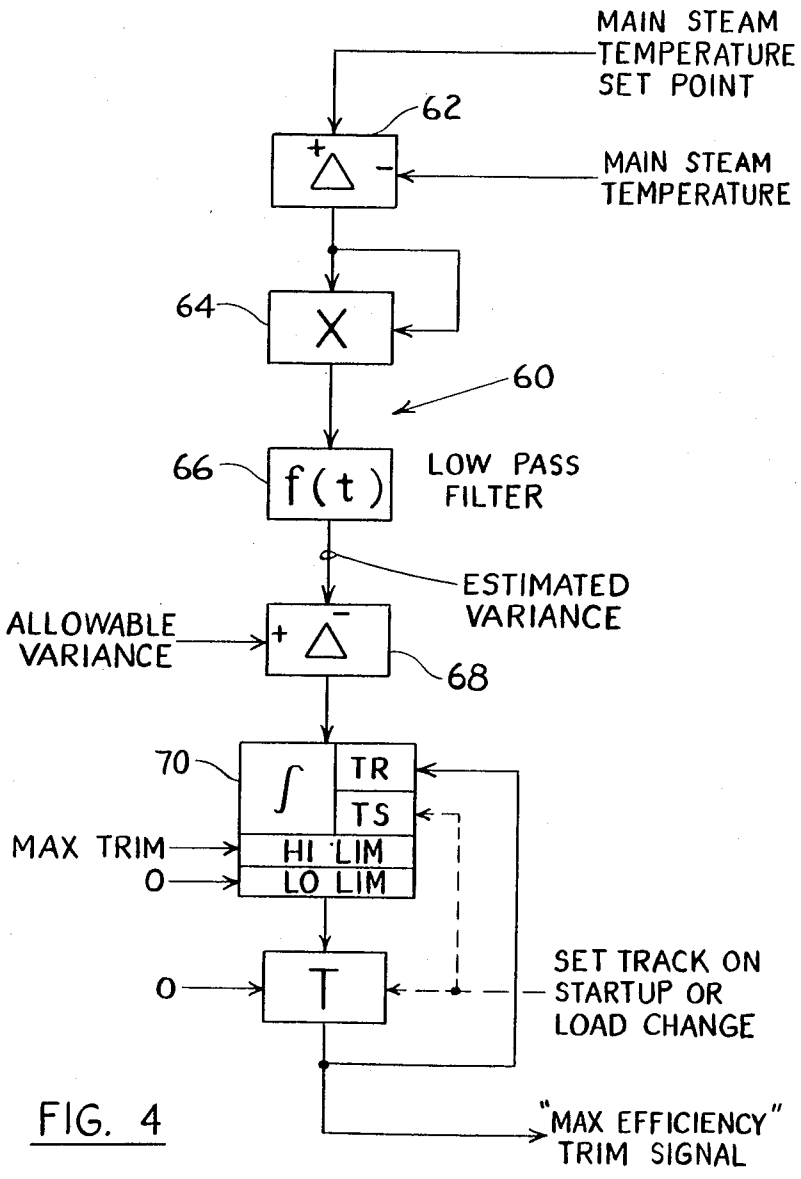
FIG. 4 is a schematic diagram of the function blocks comprising a first embodiment of the present invention.

In one embodiment of the invention, the maximum efficiency trim computation apparatus 50 is comrpised of control logic 60, shown schematically in FIG. 4. In this Figure, the main steam temperature set point (the output signal from the summation function block 52) is applied to the positive input to a difference function block 62, and the measurememt of the main steam temperature, as determined by the temperature transmitter 18, is applied to the negative input to this function block 62. The output of the function block 62, which represents the difference between the main steam temperature set point and the main steam temperature, is applied to both inputs of a multiplication function block 64 which produces an output signal representative of the square of this difference. The output signal produced by the function block 64 is passed through a low pass filter function block 66 to eliminate unwanted "noise" and is then applied to the negative input to a difference function block 68 which has a value for the "allowable variance" connected to its postive input. The output signal from the function block 68 is applied to the input to an integrator function block 70. If the output signal produced by the function block 68 is positive, thus indicating that the existing variance is less than the allowable variance, the integrator function block 70 produces a "maximum efficiency trim signal" at its output which causes the main steam temperature set point produced by the summation function block 52 to be slowly "ramped upward". Such ramping continues until the "maximum set point" is reached. Conversely, if the output signal produced by the function block 70 is negative, thus indicating that the existing variance is greater than the allowable variance, the "maximum efficiency trim signal" produced by the function block 70 causes the main steam temperature set point produced by the summation function block 52 to be slowly "ramped downward". It should be noted that the output of the integrator function block 70 is initially set at zero until steady-state operating conditions are reached, at which time the above logic begins to operate. In addition, during start-up or load change conditions, the output of function block 70 is reset to zero.

In summary, when the variance of the main steam temperature with respect to the main steam temperature set point is less than the allowable variance, the main steam temperature set point is slowly ramped upward. In contrast, if the foregoing variance is greater than the allowable variance, the main steam temperature set point is ramped downward. In addition, when steady-state operating conditions have been achieved, the main steam temperature set point is constant. In this manner, the main steam temperature within the system is maintained at its maximum safe level and boiler/turbine efficiency is maximized.

Figure 5:
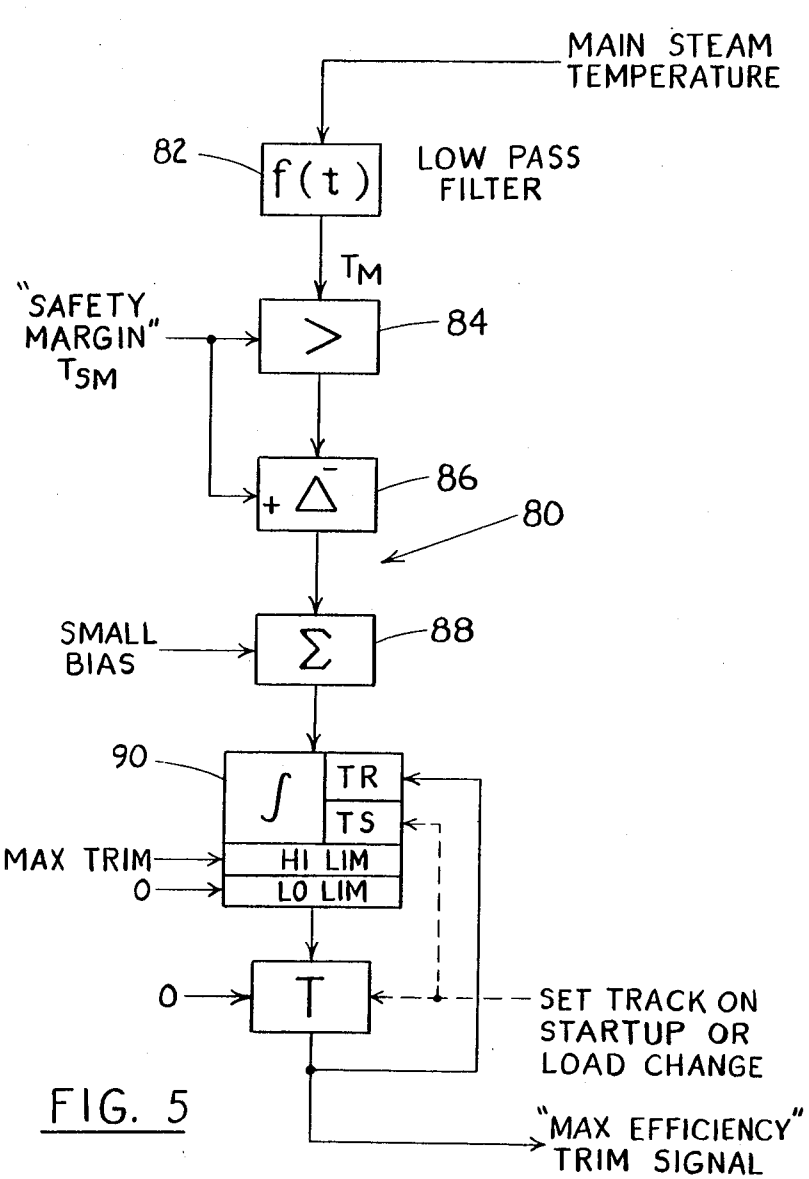
FIG. 5 is a schematic diagram of the function blocks comprising a second embodiment of the present invention.

In another embodiment of the present invention, the maximum efficiency trim computation apparatus 50 is comprised of control logic 80, shown schematically in FIG. 5. In this Figure, the measurement of the main steam temperature, as determined by the temperature transmitter 18, is passed through a low pass filter function block 82 to remove unwanted "noise". The output of the low pass filter function block 82 and a "safety margin" parameter ($T_{SM}$) are applied as inputs to a high selecting function block 84. This "safety margin" parameter ($T_{SM}$) is selected to be some "safe" level below the maximum allowable temperature for the system. The output of the high selecting function block 84, which is $T_{SM}$ when $T_M \leqq T_{SM}$ and $T_M$ when $T_M > T_{SM}$, is applied to the negative input to a difference function block 86. The safety margin parameter ($T_{SM}$) is applied to the positive input to this function block 86. The output of the function block 86, which is zero whenever $T_M \leqq T_{SM}$ and $(T_{SM} - T_M)$ whenever $T_M > T_{SM}$, is applied as an input to a summation function block 88 wherein a small bias signal is added thereto. The output of the summation function block 88 is applied to the input to an integrator function block 90 which produces a "maximum efficiency trim signal" at its output. If the main steam temperature ($T_M$) is less than or equal to the safety margin parameter $T_{SM}$ ($T_M \leqq T_{SM}$), the output of the summation function block 88 is the small bias signal. This small bias signal causes the output of the integrator block 90 to increase slowly, which, in turn, causes the main steam temperature set point produced by the summation function block 52 to be slowly "ramped upward". Such ramping continues until the main steam temperature ($T_M$) starts to exceed the safety margin parameter ($T_{SM}$). When this latter condition occurs, the output of the summation function block 88 becomes negative which, in turn, results in the integrator function block 90 producing an output signal ("maximum efficiency trim signal") which causes the main steam temperature set point produced by the summation function block 52 to be "ramped downward". Eventually, when steady-state conditions exist within the system, the excursions of the main steam temperature $T_M$ above the safety margin parameter ($T_{SM}$) will just cancel out the small bias signal added to the system by the summation function block 88. At this point, the "maximum efficiency trim signal" will stabilize at a constant value that generates the most efficient value of main steam temperature set point. As in the case of the embodiment shown in FIG. 4, the output of the function block 90 in FIG. 5 is initially set at zero. This value also is reset to zero during startup or load change conditions.

Even though function blocks have been used throughout the foregoing without an indication as to the type of operating mechanisms employed, it is understood that any type of controls, i.e., electronic, electrical, electro-mechanical, mechanical, hydraulic, pneumatic, can be utlized for the performance of the operations signified by the blocks.

Certain modifications and improvements will occur to those skilled in the art upon reading the foregoing, It should be understood that all such modifications and improvements have been deleted herein for the sake of conciseness and readability, but are properly within the scope of the following claims.

We claim:

1. A system for maximizing the main steam temperature in a power generation boiler/turbine installation comprising means producing an output signal representative of the temperature of the steam entering the turbine, means for comparing said output signal representative of said turbine steam temperature with a maximum safe operating temperature of said boiler/turbine installation, said comparing means producing an output signal representative of the difference between said turbine steam temperature and said maximum safe operating temperature, and means responsive to said difference output signal producing a trim signal to vary a set point for determining said turbine steam temperature.

2. The system as defined in claim 1 wherein said output signal producing means produces a signal representative of the differences between the temperature of the steam entering the turbine and said turbine steam temperature determining set point.

3. The system as defined in claim 2 wherein said maximum safe operating temperature is representative of the allowable variance between said temperature of the steam entering the turbine and said turbine steam temperature set point.

4. The system as defined in claim 1 including means to set said trim signal to zero until steady-state operation of the boiler/turbine installation has been achieved.

5. The system as defined in claim 1 including means to set said trim signal to zero during start-up or load change to the boiler/turbine installation.

* * * * *